US005809718A

United States Patent [19]

Wicks

[11] Patent Number: 5,809,718

[45] Date of Patent: Sep. 22, 1998

[54] MODULAR MOULDING SYSTEM

[76] Inventor: Stacy Robert Wicks, 7622 Hardy La., Granite Bay, Calif. 95746

[21] Appl. No.: 601,286

[22] Filed: Feb. 16, 1996

[51] Int. Cl.[6] ..... E04B 2/00

[52] U.S. Cl. ..... 52/287.1; 52/288.1

[58] Field of Search ..... 403/294; 52/287.1, 52/275, 279, 282.3, 288.1

[56] References Cited

U.S. PATENT DOCUMENTS 5,199,237 4/1993 Juntunen ..... 52/287.1

*Primary Examiner*—Creighton Smith
*Attorney, Agent, or Firm*—Harry G. Weissenberger

[57] ABSTRACT

A modular moulding system uses slotted blocks which are first individually mounted on a support surface. A length of moulding runner is inserted deeply into the slot of one of the blocks, and then partially withdrawn while being inserted into the slot of the other block. In this manner, moulding can be assembled by one unskilled person working alone, and accuracy of the cut of moulding runners is not critical.

7 Claims, 4 Drawing Sheets

MODULAR MOULDING SYSTEM

FIELD OF THE INVENTION

This invention relates to decorative mouldings, and more specifically to a modular moulding system which allows moulding to be installed by a single unskilled person.

BACKGROUND OF THE INVENTION

Conventionally, mouldings such as crown mouldings, chair rails, baseboards, and door frame mouldings have been custom-cut and installed by skilled craftsmen. With the increasing cost of skilled labor, and the increasing interest of homeowners in do-it-yourself home renovation projects, it has become desirable to provide a means for relatively unskilled persons working alone with a minimum of tools to easily install and maintain attractive mouldings in the home.

One of the main problems for the do-it-yourselfer in the installation of mouldings is the need for precise measurement of components to avoid gaps or overlaps. Another is the need for skill in cutting or sawing components to produce true and correctly angled cuts for professional-looking joints and miters. A third problem is the fact that do-it-yourselfers frequently work alone at odd hours and are unable to call upon others to assist in supporting and aligning moulding components during installation.

SUMMARY OF THE INVENTION

The invention overcomes these problems by providing a system in which prefabricated corner pieces, rosettes and/or spacers are first individually positioned and fastened to the wall, ceiling and/or door. These pieces are equipped with retaining slots and tabs of such shape and dimensions that movable runners, rails, headers or casings of approximately appropriate length can be individually inserted and retained therein after the pieces are fixed in place. For this purpose, the retaining slots are deep enough to allow the movable elements to be fully inserted in a fixed element at one of their ends, and then partially withdrawn while being partially inserted into another fixed element at the other end. Once installed, disassembly movement of the movable elements can be prevented by blocking the slots with the aid of nails, screws or pegs. One advantage of the invention is that by making the slot-blocking means removable, the moulding can easily be disassembled for cleaning or painting, or for the replacement of damaged runners.

Guide tabs on the fixed elements may be provided to so interact with corresponding recesses in the movable elements as to guide the movable elements into tight and accurate alignment with the fixed elements during installation, and to help hold them in alignment with the retaining slots prior to insertion where appropriate.

It is also sometimes practical, particularly in connection with rosettes for door frame mouldings, to use the retaining slot system of this invention for the head of the door frame and the twist-lock miter system of copending application Ser. No. 08/521,183, filed 30 Aug. 1995, for the casing of the door frame.

DETAILED DESCRIPTION OF THE PREFERRED EMBODIMENTS

Figure 1:
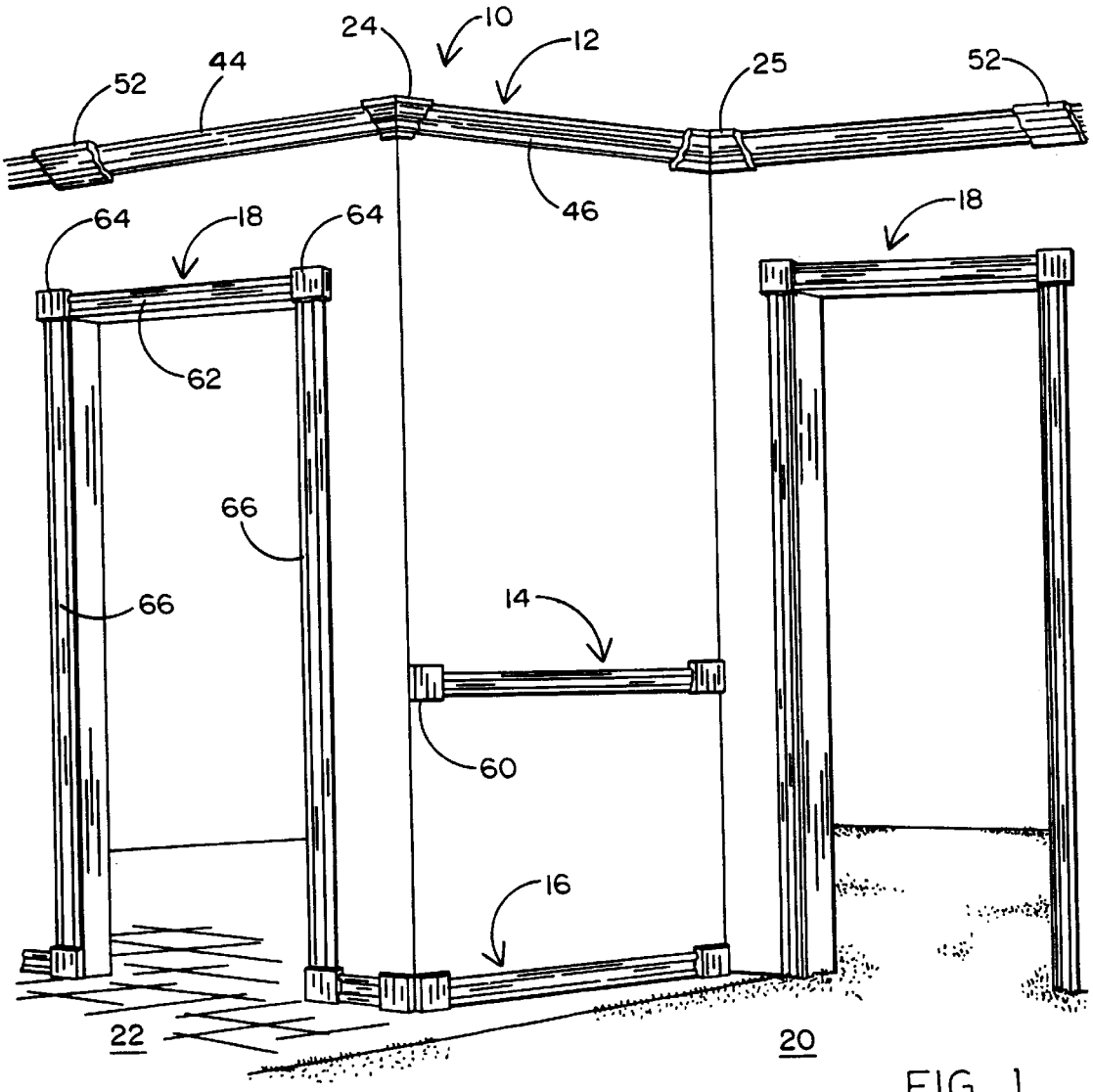
FIG. 1 is a perspective view of a room illustrating the uses of various embodiments of the invention.
Figure 2:
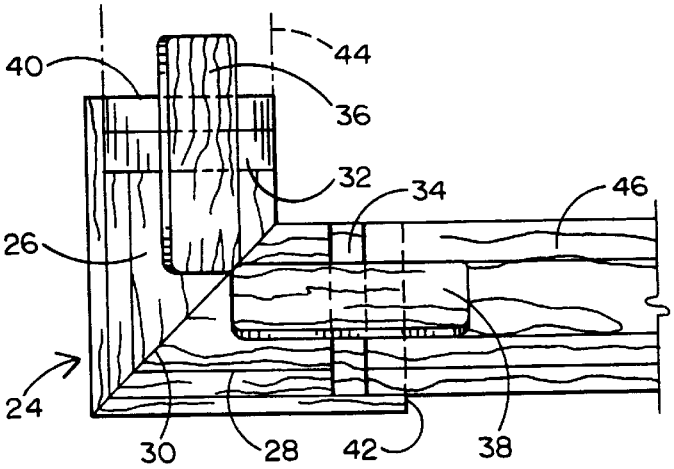
FIG. 2 is a detail plan view of a corner piece.

As best show in FIG. 1, the system of this invention is designed to enable unskilled persons to easily assemble and attach decorative mouldings to various surfaces of a room 10. For example, the invention may be used for crown mouldings 12, chair rails 14, baseboards 16, or door frame mouldings 18. In the latter case, it may be advantageously adapted to rooms equipped with a carpet 20 or to rooms with a hard floor 22, as hereinafter described. It will be understood that although the elements of the system are shown in the drawings as relatively plain-surfaced, they may be shaped and decorated in any desired manner consistent with their interrelational functioning as described herein.

FIGS. 2 through 5 illustrate the use of the invention in the crown moulding 12. In the plan view of FIG. 2, the corner piece 24 is shown to consist of two pre-assembled corner blocks 26, 28 which are permanently joined at the miter 30. Elongated slots 32, 34 are formed in the rear faces of blocks 26, 28. Guide tabs 36, 38 extending beyond the ends 40, 42 of the blocks 26, 28 are provided on the rear faces of blocks 26, 28 to cooperate with slots 32, 34 and runners 44, 46 for purposes described below.

Figure 3A:
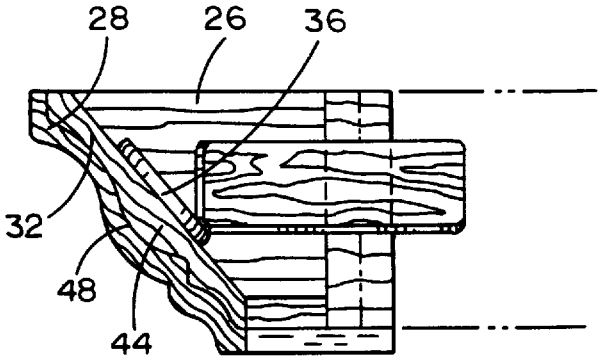
FIG. 3 is an end elevation of the corner piece of FIG. 2 with a runner inserted.
Figure 3B:
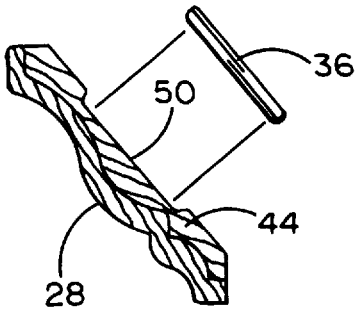

FIG. 3 shows, in an end view of the block 26, the cross-sectional shape of the slot 32 and the guide tab 36. The front face 48 of the slot 32 is identical in shape to the front face of the runner 44. Preferably, if the runner 44 is not symmetrical in cross section, that shape is sufficiently asymmetrical to make it readily apparent to the user which way is right side up for positioning the runner 44. On its rear face, the runner 44 is provided with a recess 50 which engages the guide tab 36 for alignment and support purposes.

Figure 4:
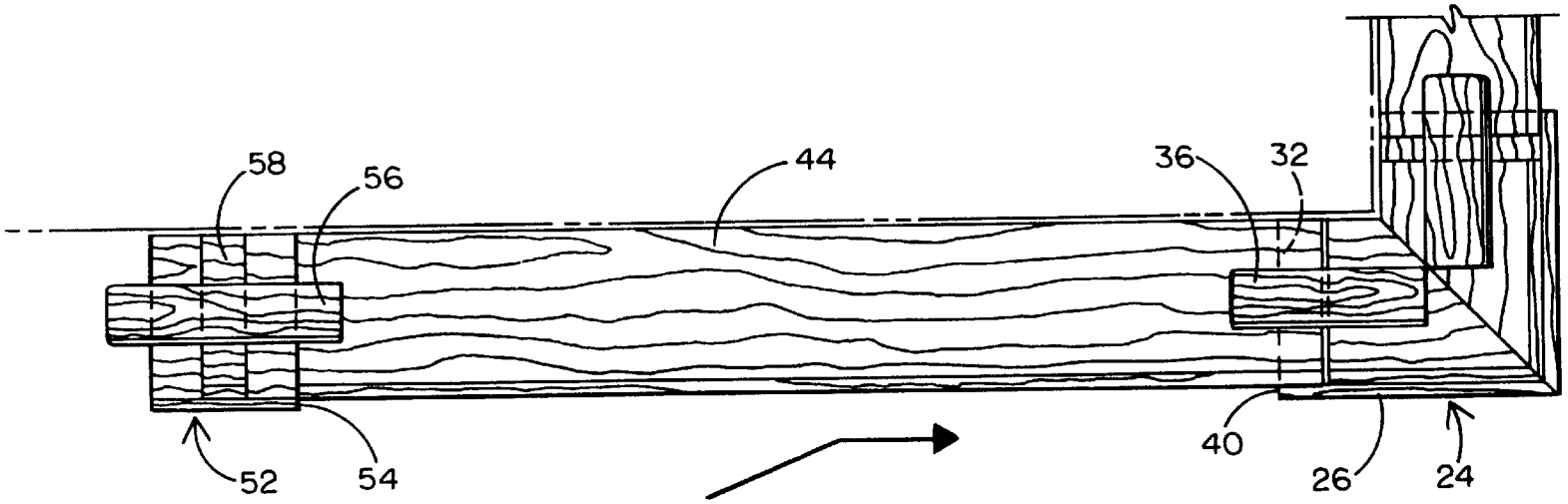
FIG. 4 is a vertical section of a moulding run along line 4—4 of FIG. 3 showing the runner during assembly.
Figure 5:
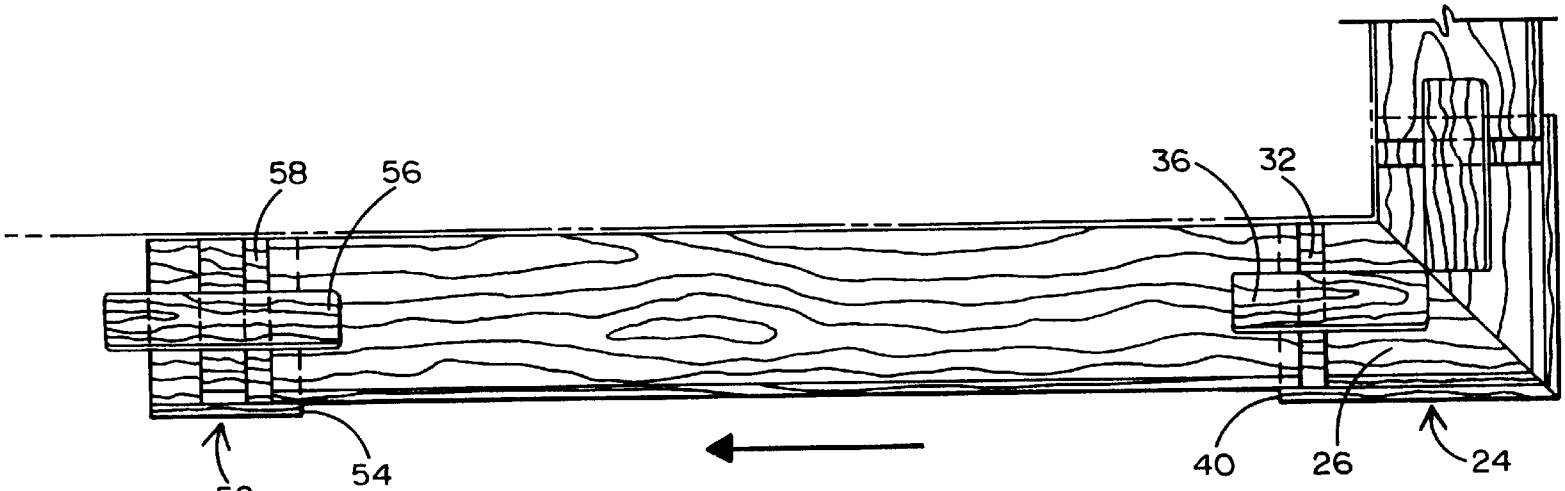
FIG. 5 is a vertical section similar to FIG. 4 but showing the moulding run after assembly.

The installation of a crown moulding section in accordance with the invention is shown in FIGS. 4 and 5. First, a pair of end pieces such as the corner piece 24 and the spacer block 52, or corner pieces 24 and 25, are secured in place on the wall and/or ceiling of the room. A runner 44 is then cut to a length just slightly less than the distance between the faces 40 and 54 of the corner piece 24 and spacer block 52, respectively, plus the depth of the slot 32. The accuracy or straightness of the cut is not critical, and even a runner length as much as one or two centimeters shorter than optimum will not cause problems in most instances.

The cut runner is now aligned with, e.g., slot 32 of the corner piece 24 by engaging the recess 50 of the runner 44 with the guide tab 36.

It should be noted that, unless the runner 44 is formed from a flexible material, the thickness of the corner block 26 and/or spacer block 52 between the front face of slot 32 and the front face of the block should be held to a minimum so as to allow placement of the runner (which at this time overlaps the block 52) in as close an alignment as possible with the longitudinal axis of the slot 32.

One end of runner 44 is now inserted into the slot 32 of block 26 as far as it will go. This brings the opposite end of runner 44 out of overlap with block 52 and makes it possible to bring the recess 50 of runner 44 into engagement with the guide tab 56 of block 52. The runner 44 is now aligned with the slot 58 of block 52. By sliding the runner 44 toward block 52 a distance of one-half the depth of slot 32, the runner 44 engages both the slot 58 and the slot 32 and is firmly held in place by them against vertical movement. The assembly can now be completed by using appropriate fasteners, such as pegs, nails or screws to block the slots 32 and 58 adjacent the ends of runner 44, or by actually driving a fastener through the block and runner on at least one end of runner 44.

It will be noted that unless a space is desired between the runner 44 and the ceiling of the room, the highest point of the slot 32 should be at the same neight as the top of corner block 26 and/or spacer block 52.

The same assembly method as described above can be used with chair rails and baseboards, except that in those instances, appropriate corner pieces, spacer blocks and end pieces such as 60 are preferably so designed as to hold the runners flat against the wall rather than at an angle.

Figure 6:
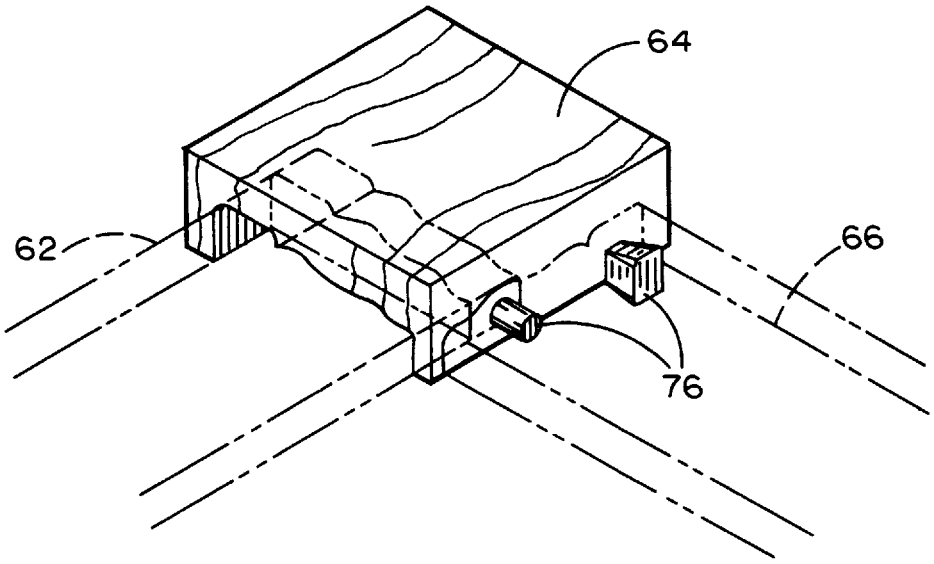
FIG. 6 is a bottom perspective view of a door rosette using a twist-lock miter connection for the casing.
Figure 7:
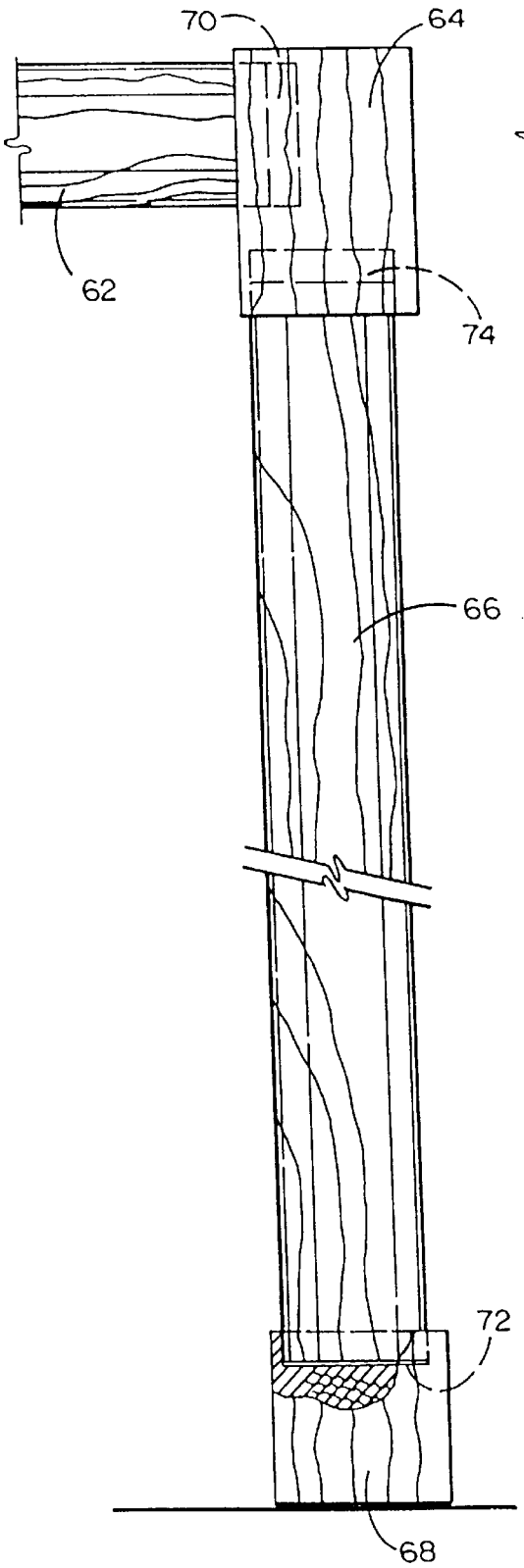
FIG. 7 is a front elevation of a door casing assembly for use in a carpeted room.
Figure 8:
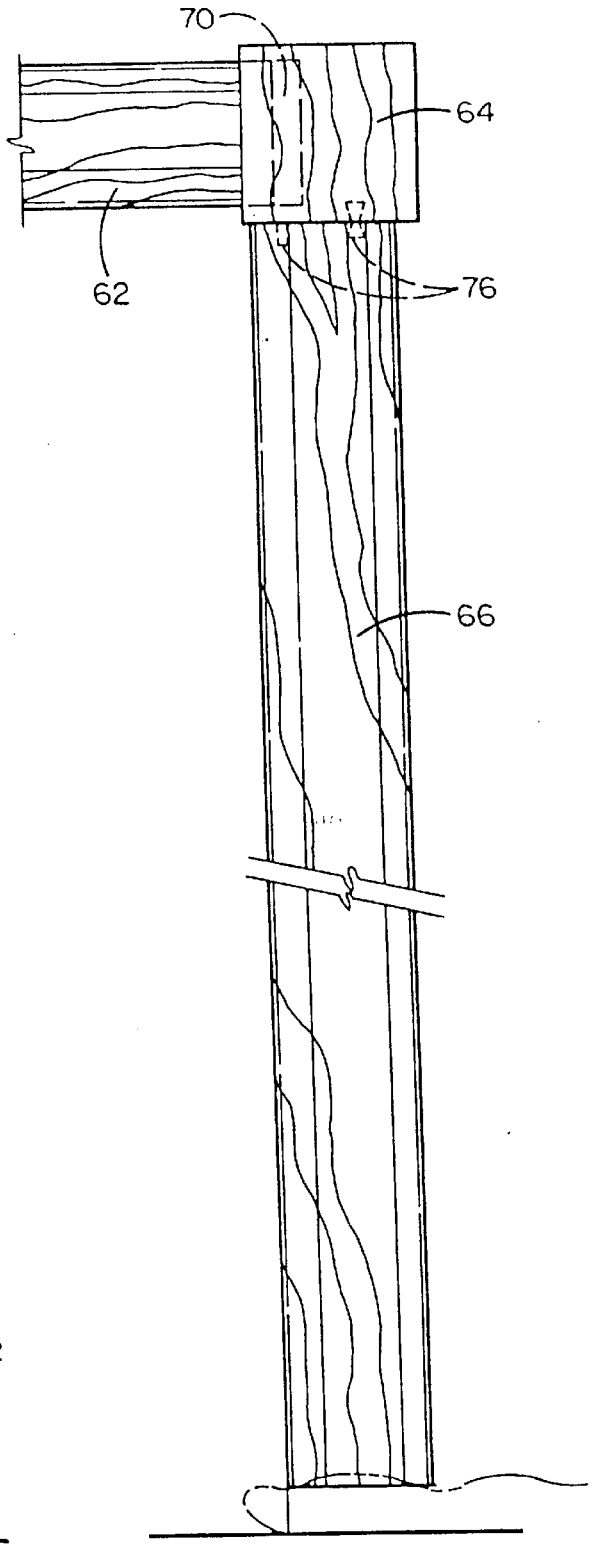
FIG. 8 is a front elevation of a door casing assembly for use in a hard-floored room.

FIGS. 6 through 8 illustrate the use of the invention in a door frame moulding. Typically, as shown in FIG. 6, a door frame of this type involves a head 62, corner blocks or rosettes 64 and casings 66. For reasons detailed below, plinth blocks 68 would normally be used on a hard floor (FIG. 7) but are unnecessary on a carpeted floor (FIG. 8).

In the arrangement of FIG. 7, the rosettes 64 and bead 62 are first assembled in the same manner as described above for crown moulding. It may, however, be advantageous, due to the small size of the rosettes 64, to omit the guide tabs of FIGS. 2 through 5 and to rely only on the slots 70 to hold the head 62 against vertical movement.

Because the weight of the casing 66 rests on the plinth block 68, it may be advantageous to make the slot 72 of the plinth block 68 only half as deep as the slot 74 in the rosette. When the casing is inserted first in the rosette 64 and then in the plinth block 68, it will rest on a solid surface without the need for any fasteners.

A somewhat different situation exists in the case where the floor is carpeted. Because the carpet 20 and its pad may be several centimeters thick, difficulties may arise in the absence of a plinth block when the slot type arrangement is used for the casing 66 in the rosette 64. Consequently, it may be advantageous to assemble the rosette 64 with the casing 66 by a twist-lock mechanism 76 (FIG. 6) such as that shown in U.S. Pat. No. 5,603,586 prior to mounting the rosette 64. The twist-lock mechanism 76 holds the casing 66 tightly against the rosette 64, while the lower end of casing 66 will be hidden by the carpet 20 so that the quality and accuracy of its cut is not critical.

Although specific embodiments of the invention have been described herein, it will be apparent to those skilled in the art that many variations, embodiments and combinations of the inventive concept are possible; consequently, the invention is not to be limited except by the scope of the following claims.

I claim:

1. A modular moulding system, comprising:

a) a first moulding element;

b) at least a pair of second moulding elements connected by said first element, said second elements each having formed therein a slot receiving said first moulding element, c) said slots being of such depth that when said second elements are fixedly mounted on a supporting surface, said first element is insertable into said slot of one of said pair of second elements far enough to clear the other of said pair of second elements prior to being partially withdrawn from said slot of said one of said pair of second elements sufficiently to be inserted into said slot of said other of said pair of second elements so as to connect said second elements;

d) said slots and first elements having surfaces that lie against each other when said first element is inserted into said slots, the shape of said surface of said slots which engages said surface of said first element being such as to match the shape of said surface of said first element throughout said depth of said slots; and e) one of said second elements including a guide member arranged to align said first element with said slot.

2. The system of claim 1, in which at least one of said second elements is a rosette having said slot on one side thereof, and a twist-lock mechanism connecting one of said first moulding elements to said rosette on a side orthogonal to said one side.

3. The system of claim 1, in which at least one of said second elements is a corner piece receiving a pair of said first elements extending at an angle to each other.

4. The system of claim 1, in which said slots are so positioned in said second elements that the top of said first element is level, when horizontally inserted into said slots, with the top of said second elements.

5. A modular moulding system, comprising:

a) an elongated first moulding element having front and rear surfaces;

b) a second moulding element, said second element having a face extending substantially parallel to said first moulding element, said face having front and rear surfaces;

c) at least one guide tab fixedly mounted on said second moulding element and extending substantially parallel to said first moulding element;

d) the cross-sectional shape of said rear surface of said second element matching the cross-sectional shape of said front surface of said first moulding element, said rear surface of said second element and said guide tab forming between them a slot into which said first element is inserted, said first element when inserted being held between said rear surface of said second element and said guide tab.

6. The modular moulding system of claim 5, in which the rear surface of said first element has a groove which is so engaged by said guide tab when said first element is inserted as to maintain said first element in alignment with said second element.

7. The modular moulding system of claim 5, in which the system includes two of said second elements, each end of said first moulding element being inserted in one of said second elements.

* * * * *